US009737127B2

(12) United States Patent
Moretti

(10) Patent No.: US 9,737,127 B2
(45) Date of Patent: Aug. 22, 2017

(54) DEVICE TO CONTAIN AND DELIVER FLUID SUBSTANCES

(71) Applicant: LUMSON S.P.A., Capergnanica (CR) (IT)

(72) Inventor: Matteo Moretti, Crema (IT)

(73) Assignee: LUMSON S.P.A., Capergnanica (CR) (IT)

( * ) Notice: Subject to any disclaimer, the term of this patent is extended or adjusted under 35 U.S.C. 154(b) by 28 days.

(21) Appl. No.: 15/045,615

(22) Filed: Feb. 17, 2016

(65) Prior Publication Data

US 2016/0255940 A1 Sep. 8, 2016

(30) Foreign Application Priority Data

Feb. 18, 2015 (IT) ..... MI2015A0229

(51) Int. Cl.
*A45D 40/00* (2006.01)
*A45D 34/00* (2006.01)
*B65D 83/00* (2006.01)

(52) U.S. Cl.
CPC ..... *A45D 40/0075* (2013.01); *A45D 34/00* (2013.01); *B65D 83/0033* (2013.01); *B65D 83/0044* (2013.01); *A45D 2200/055* (2013.01)

(58) Field of Classification Search
CPC ..... A45D 40/0075; A45D 34/00; A45D 2200/055; B65D 83/0033; B65D 83/0044
USPC ..... 222/405
See application file for complete search history.

(56) References Cited

U.S. PATENT DOCUMENTS 4,205,766 A 6/1980 White
5,590,835 A 1/1997 Rosenthal et al.
5,992,705 A * 11/1999 Lhuisset ..... A45D 40/04 222/386
2006/0071034 A1* 4/2006 Bougamont ..... A45D 34/04 222/390

FOREIGN PATENT DOCUMENTS

EP 0641604 A2 3/1995
JP 2007112478 A 5/2007

OTHER PUBLICATIONS

EP Search Report of Oct. 9, 2015 for Italian Patent Application No. MI2015A000229 to LUMSON S.p.A. filed Feb. 18, 2015.

* cited by examiner

*Primary Examiner* — Donnell Long
(74) *Attorney, Agent, or Firm* — Vorys, Sater, Seymour and Pease LLP

(57) ABSTRACT

A device to contain and deliver fluid substances includes: a container including a housing suitable for containing a substance to be delivered; a feed element for feeding the substance outside the container, including a piston portion inserted inside the housing of the container, and a conveyance portion connected to the piston portion; a dispenser cap connected to the conveyance portion and such as to push the piston portion into the housing of the container and to deliver the substance; at least one element to guide the movement of the piston portion into the housing of the container; wherein the piston portion of the feed element is operated only manually by acting onto the dispensing cap.

15 Claims, 16 Drawing Sheets

DEVICE TO CONTAIN AND DELIVER FLUID SUBSTANCES

The present invention refers to a device to contain and deliver fluid substances.

More specifically it refers to a device to contain and deliver fluid substances, including creams or other beauty products, and in particular of a type suitable for delivering one dose only, or for delivering two or three doses of the fluid substance.

Devices are presently known to contain and deliver fluid substances which include a manually-operatable pumping member, like for instance a pump or a valve, connected to the neck of a bottle in which the fluid substance is contained.

Such pumping members allow, through a manual operation, to exert a single pressure onto a dedicated head, to deliver a predetermined dose of the fluid substance. The known pumping members are also provided with return means, for instance a spring, which allow to make the head of the pumping member automatically return to its initial rest position, ready to deliver a new dose of the substance when the user exerts a new pressure.

However, such pumping members often have a complicated structure, which comprises a high number of components. This makes the known pumping members have dimensions that unlikely can be reduced.

This represents a problem in the case that one wishes to decrease the outer dimensions of the device to contain and deliver the substance, for instance whenever it is a matter of single-dose devices, or devices that allow to deliver a limited number of doses, for instance three or four at the most.

For these single-dose devices, there are micropumps which allow to keep the dimensions of the assembly reduced. However, these micropumps complicate the structure of the single-dose dispenser device, and above all make it more expensive. It goes without saying that the problem of cost is very important in the sector of single-dose devices, which must be economical.

A structurally much more simple alternative consists of providing a bottle closable by a cap, without any pumping member. However this solution is not comfortable in that, in order to access the product, it is necessary to open the cap, and then to close it again after picking the substance up. In addition, without a pumping member it is not possible any longer to dispense predetermined doses of substance accurately.

Document U.S. Pat. No. 4,205,766 discloses a device for delivering one or two substances. Such element comprises a first lower container wherein a second container is inserted sealingly sliding. Exerting a thrust on an upper wall of the upper container this latter is made slide in the first container, triggering the exit of a first substance through a feed channel. In the meantime a second substance contained in the second container is fed outside the device by means of the sealingly sliding of a piston inserted in the second container. Such device is provided with a particularly complicated structure which makes it unsuitable for a use as a single dose dispenser.

Document JP 2007/112478 illustrates a device for delivering a fluid substance featuring a complicated structure, composed of different pieces assembled together. Manufacturing a single dose device with such a structure is very complicated.

Document EP 0 641 604 discloses a dispenser device comprising a piston inserted sealingly sliding in a container, and provided with an inner channel for feeding a fluid substance from the container towards the outside, through a dispenser cap placed in communication with the aforesaid dispense channel. This device does not offer an optimal guidance of the piston, which implies the risk that the user does not manage to dispense the whole fluid substance in a single pressure. Furthermore this device does not allow to prevent an accidental actuation of the dispenser cap.

Therefore, it is an object of the present invention to provide a device to contain and deliver fluid substances that features a simple construction, with a reduced number of component parts.

Another object of the present invention is to provide a device to contain and deliver fluid substances that allows to dispense fluid substances in a simple manner and in one or more predetermined doses.

A further object of the invention is to provide a device to contain and deliver fluid substances that possibly has reduced dimensions, and possibly is emptied in a single actuation in a safe and easy manner.

A further object of the invention is to realize a device to contain and deliver fluid substances without the risk of accidentally actuating the delivering of the fluid substance contained therein.

These objects and others are achieved by providing a device to contain and deliver fluid substances implemented according to the technical teachings of the attached claims.

Further features and advantages of the invention will be apparent from the description of a preferred, but not exclusive, embodiment of the device to contain and deliver fluid substances, illustrated for explanatory hence not limitative purposes in the attached drawings, wherein.

Figure 1:
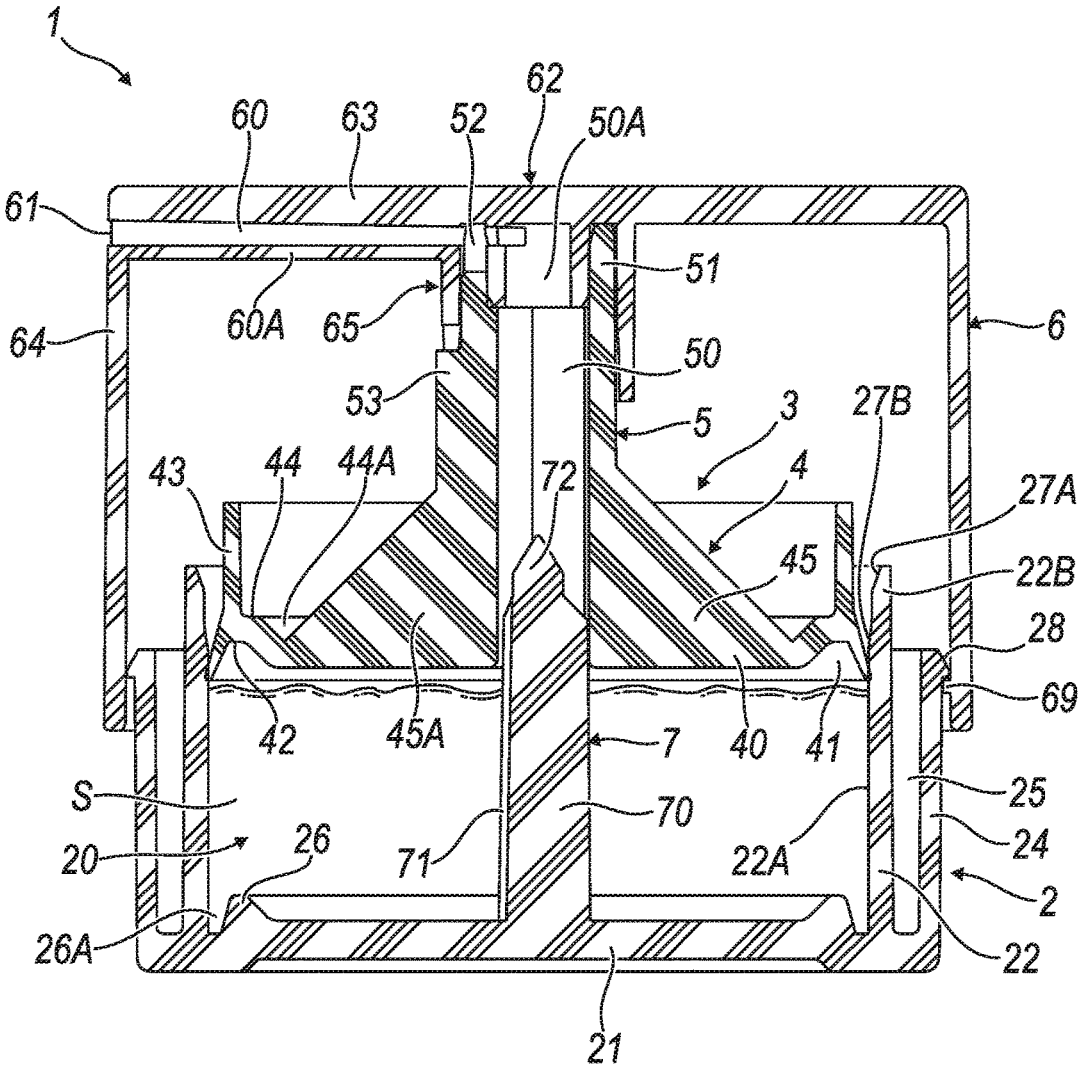
FIG. 1 is an axial sectional view of a device according to the present invention in a first operating configuration and at the start of delivering the fluid substance.
Figure 2:
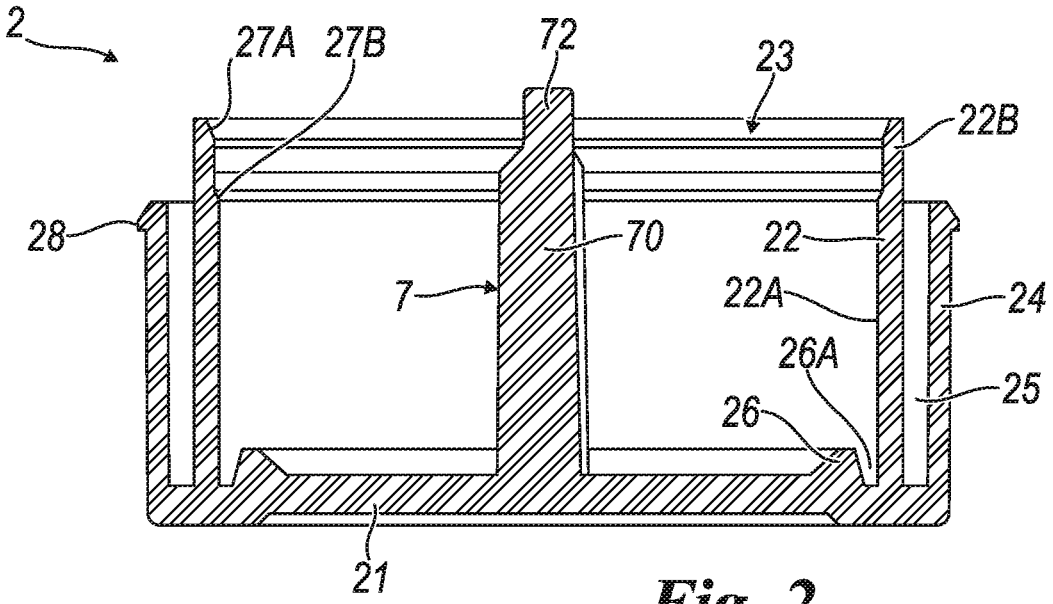
FIG. 2 is a cross-sectional view of a container of the device illustrated in FIG. 1.

With reference to FIGS. 1 thru 14, the reference numeral 1 indicates a device to contain and deliver fluid substances according to a first embodiment of the present invention.

In the context of the invention, the fluid substances contained in the device 1 can be of a type whatsoever, but preferably are they creams.

The device 1 to contain and deliver fluid substances comprises a container 2 comprising a housing 20 suitable for containing a substance S (FIG. 1) to be delivered, wherein the housing 20 has a bottom wall 21 and at least one side wall 22 delimiting an opening 23 (see FIGS. 1 thru 4, 12, and 14).

According to a advantageous embodiment of the device 1, the container 2 comprises an outer side wall 24 separate and different from the side wall 22 of the housing 20 containing the substance S to be delivered. The outer wall 24 is preferably parallel to the side wall 22 of the housing 20 and is separated therefrom by such a gap 25 as to allow a possible deformation of the outer wall 24 without causing a deformation of the side wall 22. In this way, it is possible for instance to print characters and/or drawings on the outer surface of the outer wall 24 without jeopardizing the form of the side wall 22 of the housing 20. Let's point out that the presence of the side wall 22 is not essential for the implementation of the invention, i.e. the housing 20 containing the substance S to be delivered might even be delimited by the outer wall 24 only.

Let's also point out that in the example illustrated in the drawings, the housing 20 is provided with a bulge 26 which projects from the bottom wall 21 along the inner surface of the side wall 22, and spaced from the latter by such a distance as to define a circumferential groove 26A along the inner surface of the side wall 22. In the example here illustrated the bulge 26 has a substantially triangular cross-section, but it is also possible to arrange a bulge 26 that has a cross-section of a shape whatsoever. However, such bulge 26 is optional in the context of the present invention.

Advantageously the side wall 22 of the housing 20 features an inner surface 22A perpendicular to the bottom wall 21, so that the housing 20 has a constant lateral dimension. Preferably such inner surface 22A features at least a flaring 27 at an upper portion 22B thereof so that the housing 20 features at least one upper zone wider than the rest of the housing 20. In the example here illustrated, the side wall 22 includes two flarings 27A, 27B consecutive and connected to each other, but one only of them might also be provided indeed.

According to the invention, the device 1 to contain and deliver fluid substances also comprises an element 3 to feed the substance S outside the container 2. Such feed element 3 features a piston portion 4 suitable for being inserted inside the housing 20 of the container 2 and for sealingly sliding against the at least one side wall 22 so as to exert a pressure onto the substance S contained in the housing 20 of the container 2, and a conveyance portion 5 connected to the piston portion 4 and featuring at least one channel 50 to convey the substance S outside the housing 20 (FIGS. 1, 5 thru 7, 12, and 14).

In a particularly advantageous way, the piston portion 4 and the conveyance portion 5 are integral with each other, but it is also possible that they are two separated elements which are reciprocally assembled together.

In the example here illustrated, the piston portion 4 comprises a plate-shaped body 40, generally referred to as "plate" or "small plate", with lateral dimensions substantially identical to the lateral dimensions of the housing 20, so that it can be inserted inside the housing 20 and sealingly slide against the inner surface 22A of the side wall 22 of the housing 20.

It is preferred that the plate-shaped body 40 be provided with at least one circumferential lip 41, suitable for exerting a sealing action whenever the feed element 3 is moved inside the housing 20 containing the substance S to be delivered. Advantageously, the circumferential lip 41 extends from the outer edge of the body 40 downwards and is oriented towards a direction diverging downwards. In this way, whenever the piston portion 4 is moved in the housing 20, the lip 41 is slightly compressed and is forced to remain in contact with the inner surface 22A of the side wall 22, thus assuring seal.

In a preferred way, the maximum lateral dimension of the circumferential lip 41 is slightly less than or equal to the maximum lateral dimension of the housing 20 of the container 2, i.e. the lateral dimension of the housing 20 at the upper portion 22B of the side wall 22 of the housing 20, should the side wall 22 be provided with the flaring 27. In this case, the flaring 27 makes it easier to insert the body 40 into the housing 20, without jeopardizing the seal of the lip 41 against the inner surface 22A of the side wall 22.

Figure 14:
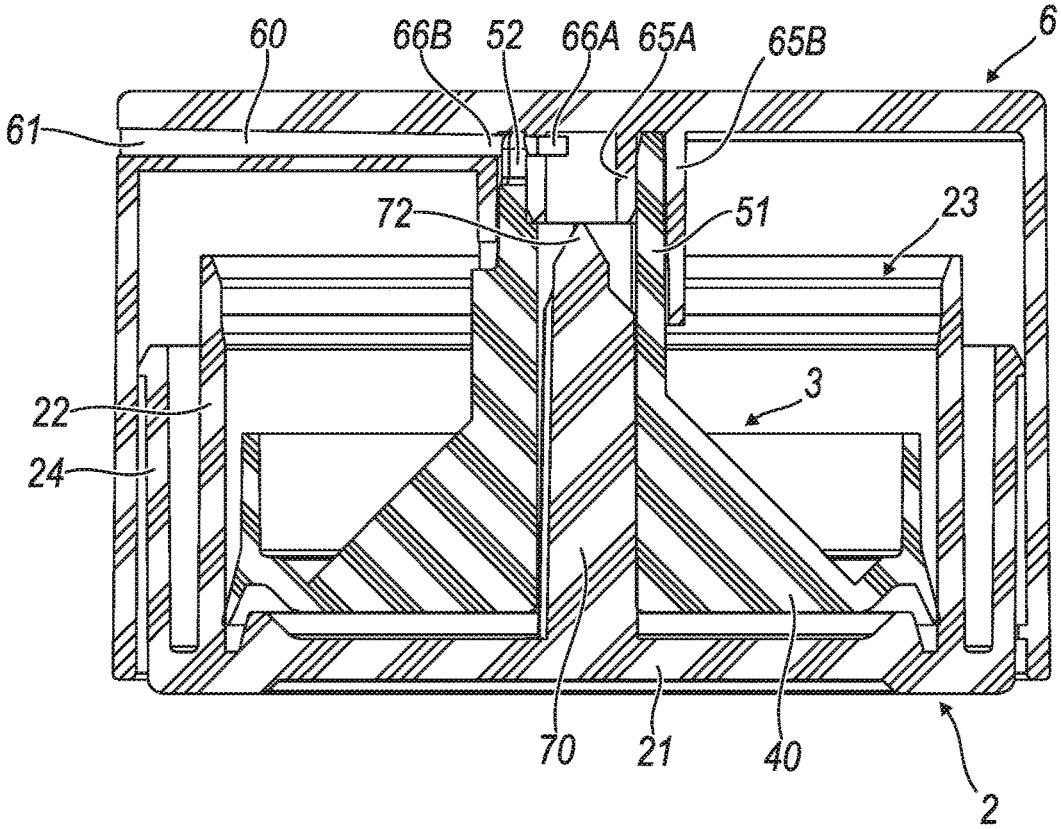
FIG. 14 is an axial sectional view of the device according to the invention at the end of delivering the fluid substance.

In an even more preferred way, the circumferential lip 41 has such shape and dimension as to make it possible to insert it into the circumferential groove 26A provided in the bottom wall 21 of the housing 20 (see in particular FIG. 14).

Figure 5:
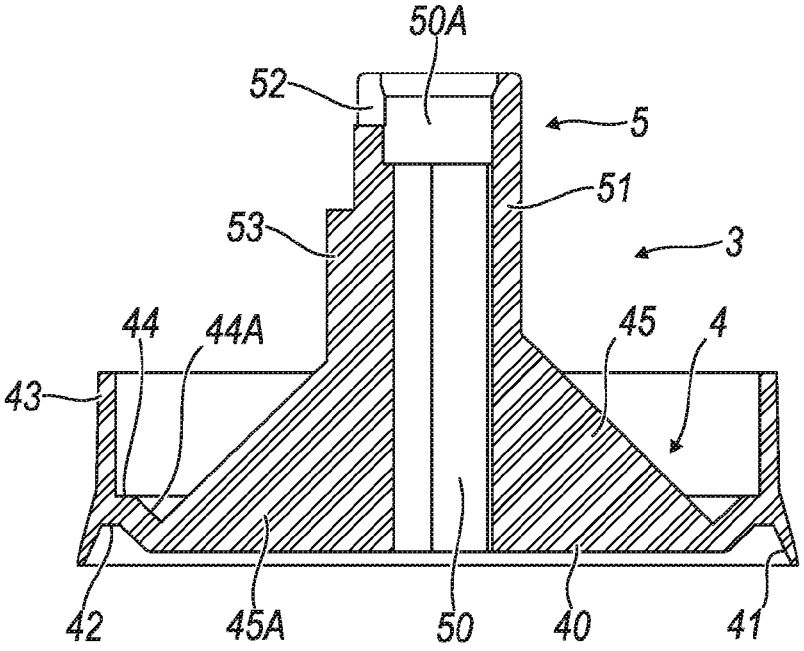
FIG. 5 is a cross-sectional view of a feed element of the device according to the invention.
Figure 6:
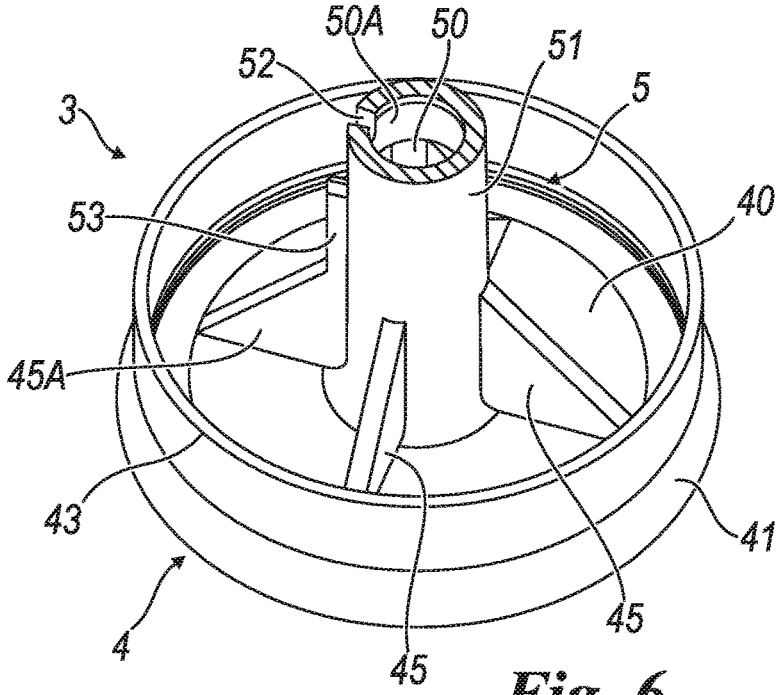
FIGS. 6 and 7 are a perspective view and a plan view respectively of the feed element illustrated in FIG. 5.

Preferably, the plate-shaped body 40 comprises in its lower surface a groove 42 which runs along the circumferential lip 41 (FIG. 5). In a particularly advantageous way, such groove 42 has such shape and dimension as to substantially match the bulge 26 that extends from the bottom wall 21 of the housing 20 suitable for containing the substance S to be delivered (see in particular FIG. 15).

In the example here illustrated, the plate-shaped body 40 of the piston portion 4 is provided with a stiffening upper side wall 43 which extends from the upper surface of the body 40 at its outer edge. This upper side wall 43 is suitable for guiding the piston element when using the device 1, in particular by preventing it from tilting in the housing 20. For an improved guidance, a second circumferential lip can be provided on the free upper edge of this upper wall 43.

Also note that the plate-shaped body 40 is provided with a stiffening upper shoulder 44 which extends along the inner surface of the upper side wall 43. The shoulder 44 is connected to the plate-shaped body 40 of the piston portion 4 via a tilted connection zone 44A.

Let's point out that the upper side wall 43, the shoulder 44, and the tilted connection zone 44A are not essential for the implementation of the invention.

The conveyance portion 5 comprises a tubular body 51, which defines at least one channel 50 for conveying the substance S outside the container 2. In the example illustrated in FIGS. 1 thru 14, the body 51 of the conveyance portion 5 centrally extends from the upper surface of the plate-shaped body 40 of the piston portion 4 in a substantially perpendicular direction.

Advantageously the channel 50 also includes an insertion end portion 50A (FIG. 5) arranged at the end portion of the body 51, and having a diameter larger than the diameter of the channel 50. The usefulness of such insertion end portion 50A will be explained later.

Advantageously the conveyance portion 5 includes an end mouth 52 suitable for allowing the substance S to be delivered to flow out of the channel 50. According to the embodiment here illustrated, such end mouth 52 includes an open recess cut above in the upper edge of the body 51, but other appropriate means could be provided, and it is possible to provide that such means be arranged in another position, provided they are in a position able to allow the substance S to flow out of the channel 50.

According to an advantageous aspect of the invention, the conveyance portion 5 also comprises an abutment element 53 located on the outer surface of the tubular body 51, and preferably longitudinally lined-up with said end mouth 52, as it will be better described below. Preferably, the abutment element 53 has a width greater than or equal to the width of the end mouth 52.

Figure 7:
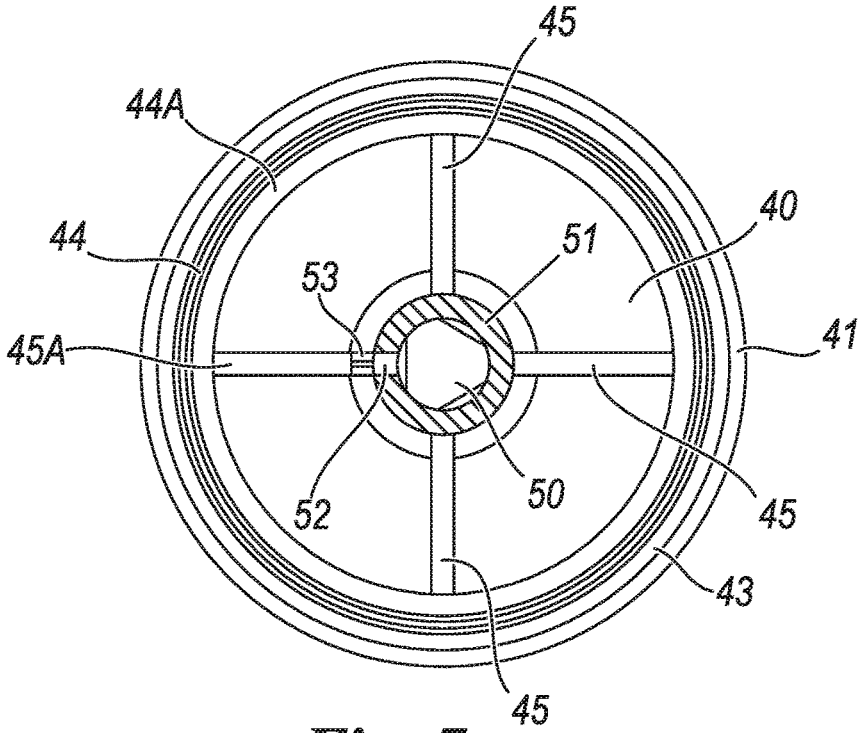
Figure 8:
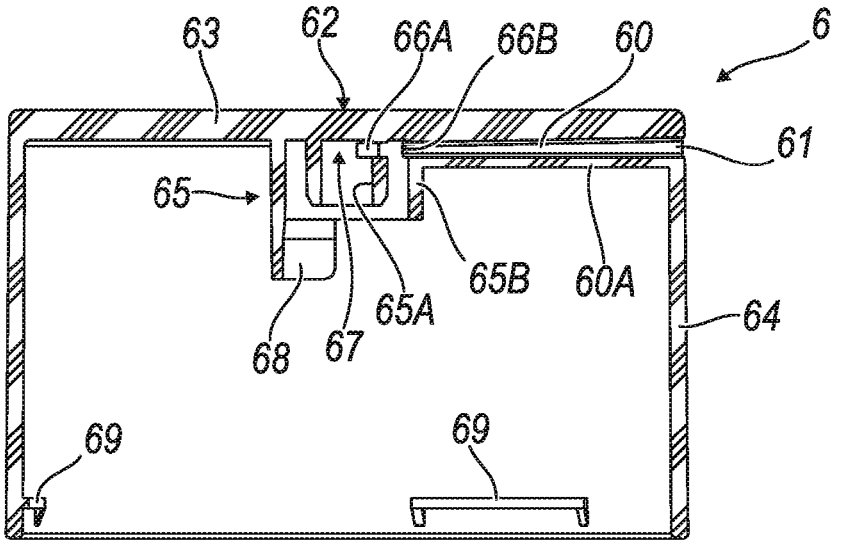
FIG. 8 is an axial sectional view of a dispenser cap of the device according to the invention.

In a preferred way, the channel 50 has a polygonally profiled cross-section, for instance a substantially hexagonal cross-section, as illustrated in the drawings (see in particular FIG. 7). It is possible to provide that the channel 50 feature a cylindrical cross-section indeed.

It is worth noting that, preferably, the feed element 3 comprises a plurality of reinforcement elements 45 which concur to reciprocally connect the piston portion 4 and the conveyance portion 5.

According to a preferred but not exclusive aspect of the invention, the housing 20 containing the substance S and the piston portion 4 are shaped in such a way as to make it possible to deliver the substance S completely by one manual operation only of the piston portion 4.

More specifically, the housing 20 containing the substance S to be delivered preferably has a volume less than 15 ml, and even more preferably substantially ranging from 3 ml to 10 ml.

According to another preferred aspect of the invention, the housing 20 of the container 2 has a cylindrical shape, and the piston portion 4 of the feed element 3 is disc-shaped so that it can be sealingly inserted against the side wall 22 of the housing 20 of the container 2, and move coaxially to the housing 20. In this event the conveyance portion 5 centrally branches off from the piston portion 4. Such preferred embodiment is illustrated in the attached drawings.

According to the present invention, the device to contain and deliver fluid substances also comprises a dispenser cap 6 comprising: at least one pipe 60 connected to the channel 50 of the piston portion 4, and having a substance S dispensing mouth 61 and a connection element 65 connecting the pipe 60 to the tubular body 51 of the feed element 3. The dispenser cap 6 is suitable for being operated manually to manually handle the feed element 3, so as to push the piston portion 4 into the housing 20 of the container 2. For this purpose the dispenser cap 6 comprises an actuation portion 62, for instance an outer surface onto which it is preferred to exert a pressure to deliver the substance S.

In a preferable way, the dispenser cap 6 comprises one upper wall 63 and at least one side wall 64. The side wall 64 of the dispenser cap 6 and the outer wall 24 of the container 2 are advantageously shaped in such a way that a portion of the side wall 64 of the dispenser cap 6 covers and slides along at least a portion of the outer wall 24 of the container 2.

According to this embodiment the actuation portion 62 consists of the upper wall 63 of the dispenser cap 6. Also, the pipe 60 of the dispenser cap 6 is delimited above by the lower surface of the upper wall 63 of the dispenser cap 6, and below by a lower wall 60A.

Advantageously the connection element 65 includes a mouth 66 for feeding the substance S to the pipe 60. In the example here illustrated, the connection element 65 comprises a first tubular offshoot 65A having such shape and dimension that it can be inserted into the insertion end portion 50A of the channel 50 of the tubular body 51 of the conveyance portion 5, so as to be in communication with the channel 50 of said conveyance portion 5.

Note that it is possible to provide in order that such first offshoot 65A have such shape and dimension that it can be inserted externally to the tubular body 51 of the conveyance portion 5 of the feed element 3.

The first offshoot 65A is provided with a first feed mouth 66A (FIG. 8), consisting of an opening cut in its upper portion.

In the example here illustrated, the connection element 65 also comprises a second tubular offshoot 65B, coaxial to the first offshoot 65A, having an identical shape, so that it can be inserted externally to the upper end of the tubular body 51 of the conveyance portion 5. It is preferred that the first and second tubular offshoots 65A, 65B be spaced away by a distance at least substantially equal to the thickness of the tubular body 51 of the conveyance portion (FIGS. 1 and 10 thru 14), so as to provide a better seal to the connection between the dispensing cap 6 and the feeding element 3.

The second offshoot 65A is provided with a second feed mouth 66A, consisting of an opening cut in its upper portion. The first and second feed mouths 66A, 66B shall be lined-up with each other in order to make it possible the outflow of the substance S to be delivered.

According to a preferred aspect of the invention, the dispensing cap 6 comprises closure means 67 for closing the end mouth 52 of the conveyance portion 5 of the feed element 3, suitable for making it possible to open/close the end mouth 52. For this purpose, the dispenser cap 6 is rotatably connected to the feed element 3 between an opening position, wherein the pipe 60 of the dispenser cap 6 is in communication with the channel 50 of the feed element 3, and a closing position, wherein the same end mouth 52 of the conveyance portion 5 is closed by the closure means 67 of the dispenser cap 6.

Concerning the rotatable connection of the dispenser cap 6 to the feed element 3, it is advantageous to provide that the tubular body 51 as well as the connection element 65 have a cylindrically profiled shape, as illustrated in the figures.

Still according to the example here illustrated, it is to be noted that the connection element 65 of the dispenser cap 6 is shaped in such a way that the upper edge of the tubular body 51 of the conveyance portion 5 is in contact with the lower surface of the wall 63 of the cap 6. In the example here illustrated, this is made possible thanks to the fact that the upper end of the tubular body 51 is suitable for being inserted into the gap between the first and second offshoots 65A, 65B.

Figure 12:
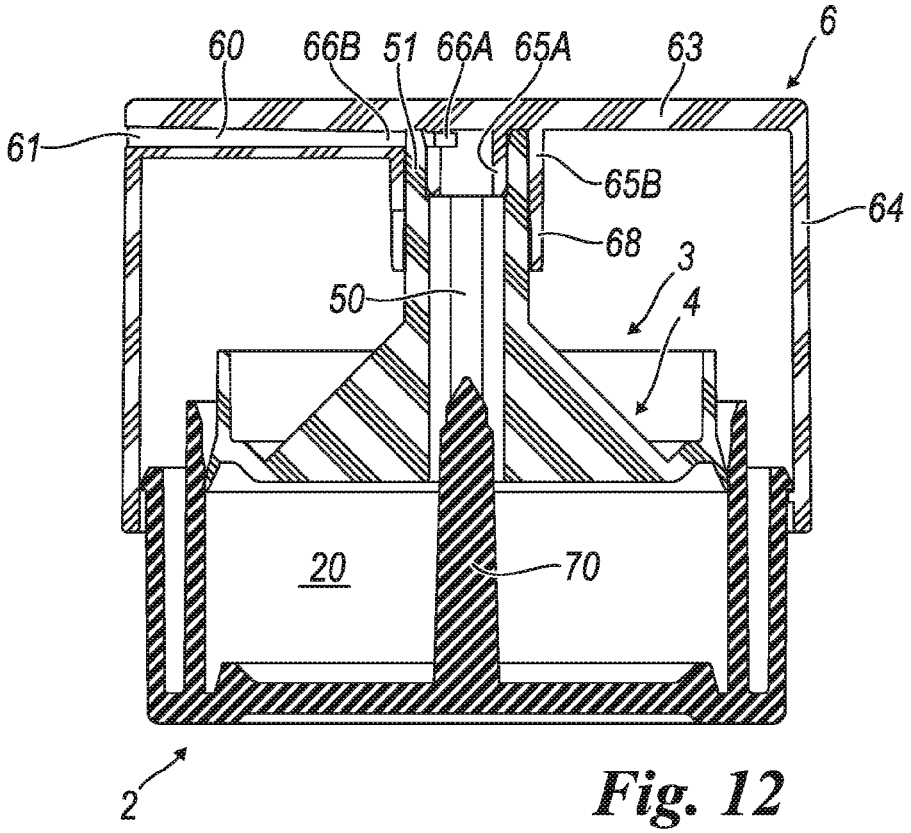
FIG. 12 is an axial sectional view of the device according to the invention in a second operating configuration, at the start of delivering the fluid substance.
Figure 13:
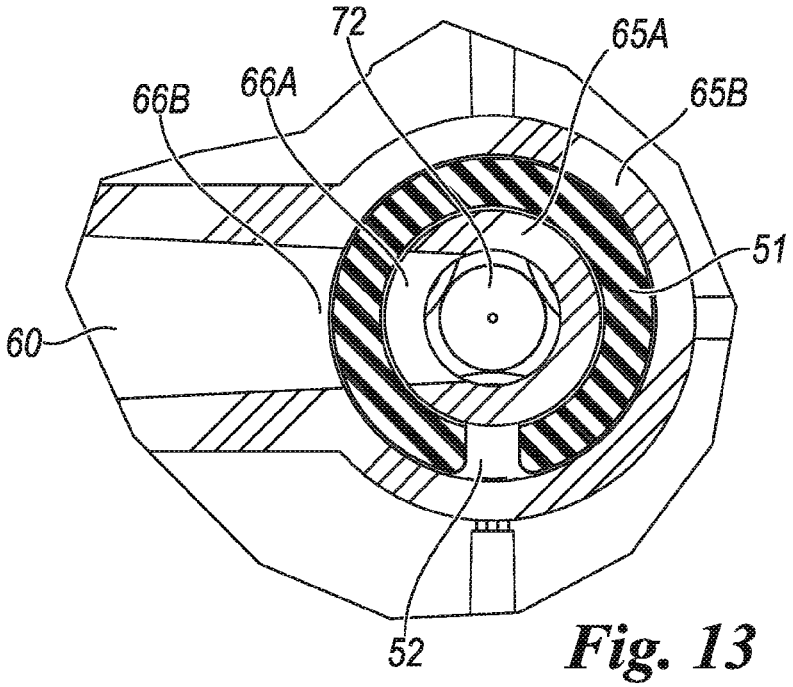
FIG. 13 is a plan and cross-sectional view of a detail of the device illustrated in FIG. 12.

The end mouth 52 of the tubular body 51 (consisting of a recess cut in the upper portion of the tubular body 51 itself) is open whenever it is lined-up with the first and second feed mouths 66A, 66B of the first and second offshoots 65A, 65B, as illustrated in FIGS. 1, 10, 11, and 14; on the contrary the end mouth 52 is closed whenever it is not lined-up any longer with the first and second feed mouths 66A, 66B, as shown in FIGS. 12 and 13. In other words, the end mouth 52 is closed by the upper portions of the first and second offshoots 65A, 65B which consequently also make-up, in this embodiment the closure means 67. It goes without saying that it is possible to provide other conventional types of closure means 67 suitable for allowing the opening/closing of the end mouth 52, however the solution described above is particularly advantageous because of its simple structure.

Preferably is the dispenser cap 6 also provided with a lock member 68 suitable for limiting the rotation of the dispenser cap 6 between an opening position of the end mouth 52 and a closing position of the end mouth 52.

In the example here illustrated, such lock member 68 consists of an arc-of-circle shaped tab which extends from the lower end of the second offshoot 65B and includes a first abutment edge 68A (FIG. 9) and a second abutment edge 68B, suitable for locking the rotation of the dispenser cap in the opening position and in the closing position respectively of the end mouth 52. Such abutment edges 68A, 68B are suitable for abutting on the abutment element 53 of the tubular body 51 of the conveyance portion 5.

For this purpose, and considering that the abutment element 53 is lined-up with the end mouth 52, the first abutment edge 68A is substantially lined-up with a side edge of the first and second feed mouths 66A, 66B of the first and second offshoots 65A, 65B of the dispenser cap 6. In this way, whenever the first abutment edge 68A is abutting on the abutment element 53, the end mouth 52 is lined-up with the first and second feed mouths 66A, 66B. The second abutment edge 68B, on the contrary, shall not be lined-up with the other side edge of the first and second feed mouths 66A, 66B of the first and second offshoots 65A, 65B.

Figure 9:
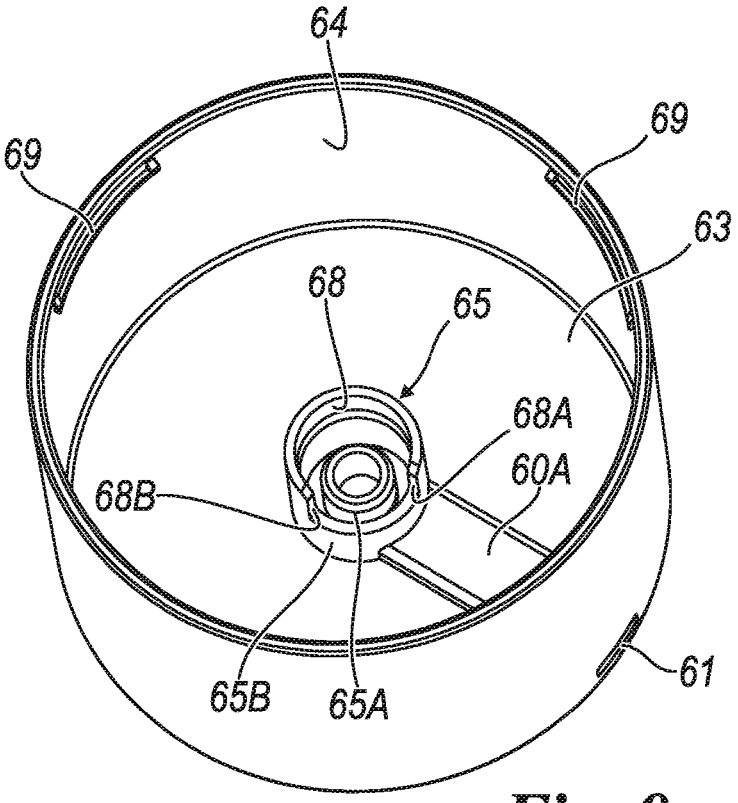
FIG. 9 is a perspective view of the inner portion of the cap illustrated in FIG. 8.
Figure 10:
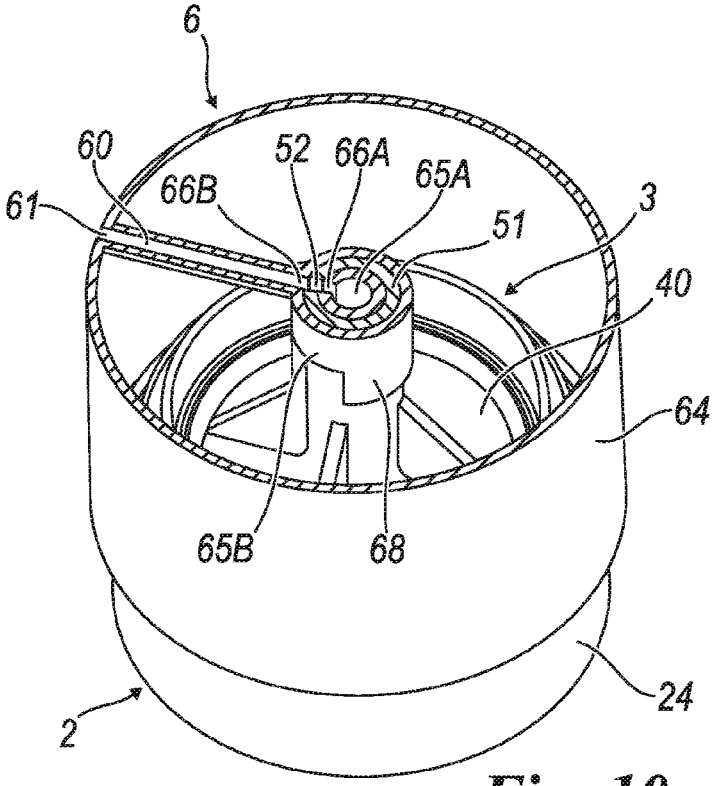
FIG. 10 is a perspective view of the device according to the invention in a first operating configuration, the cap being cross-sectioned.
Figure 11:
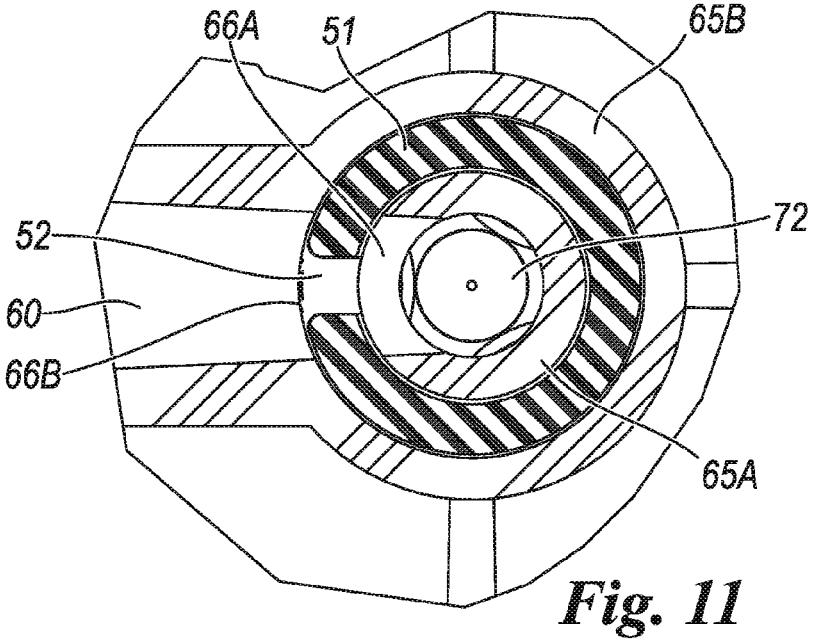
FIG. 11 is a plan view and cross-sectional view of a detail of the device illustrated in FIG. 10.

For example, in the embodiment here illustrated, the first abutment edge 68A and the second abutment edge 68B are spaced away from each other by an angle substantially equal to 90° (FIG. 9). In this way, whenever the second abutment edge 68B is abutting on the abutment element 53, the end mouth 52 is rotated by an angle substantially equal to 90° with respect to the first and second feed mouths 66A, 66B (FIG. 13).

Other configurations of the abutment element 53 and of the abutment edges 68A, 68B are possible indeed. For example, the abutment element 53 might not be lined-up with the end mouth, which entails that, the first abutment edge shall not be lined-up with a side edge of the first and second feeding mouths 66A, 66B.

It is also worth noting that for the implementation of this embodiment, it is possible to provide one offshoot only of the connection element 65. In this event, it is more advantageous to have the second offshoot 65B inserted outside the body 51 of the conveyance portion 5.

In the case that the dispenser cap 6 comprises an upper wall 63 and a side wall 64, a portion of which covers and slides along a portion of the outer side wall 24 of the container 2, it is preferred that the dispenser cap 6 be provided with engagement means 69 located in the side wall 64 of the dispensing cap 6, and that the container 2 be provided with engagement counter-means 28 suitable for cooperating with said engagement means 69 of the dispenser cap 6, so as to prevent said dispenser cap 6 from being accidentally removed after it has been associated with the container 2.

Advantageously, the engagement means 69 comprise a plurality of teeth angularly spaced away from each other, along a circular trajectory, transversal with respect to the axis of the dispenser cap 6, on the inner surface of the side wall 64 of the dispenser cap 6, and the engagement counter-means 28 comprise a continuous circular tooth which projects from the outer surface of the outer wall 24 of the container, along a circular trajectory, transversal with respect to the axis of the container 2.

The device 1 to contain and deliver fluid substances also comprises at least one guide element 7 for guiding the movement of said piston portion 4 in said housing 20 of the container 2. Such guide element 7 is suitable for guiding the movement of the piston portion 4 in a direction parallel to the axis of the container 2 so that the piston portion 4 slides along the side wall 22 of the housing 20 without jeopardizing its seal.

Preferably is the guide element 7 provided in the container 2, and it comprises a rod 70 extending from the bottom wall 21 of the housing 20 of the container 2, and suitable for being inserted into the channel 50 of the conveyance portion 5 of the feed element 3. In order for the device 1 to operate, it is necessary that the rod 70 comprise at least one duct 71 to make the substance S to be delivered flow through between the outer surface of the rod 70 and the inner wall of the channel 50. According to a preferred aspect of the invention, the rod 70 is arranged coaxially with respect to the housing 20, as can be seen in the drawings.

It is to be précised that the rod 70 can be made in a single piece with the container 2, but it is possible as well it to be a separated element which is connected to the container 2.

The presence of this rod 70 suitable for being inserted in the channel 50 of the conveyance portion 5 allows to perform a guidance of the feed element 3 both internally (through the rod 70) and externally (through the circumferential lip 41 of the piston portion 4).

According to an advantageous aspect of the invention, the rod 70 is suitable for being inserted into the channel 50 of the conveyance portion and has a maximum lateral dimension substantially equal to the maximum lateral dimension of the channel 50, to optimize the guidance of the movement of the piston portion 4.

Figure 3:
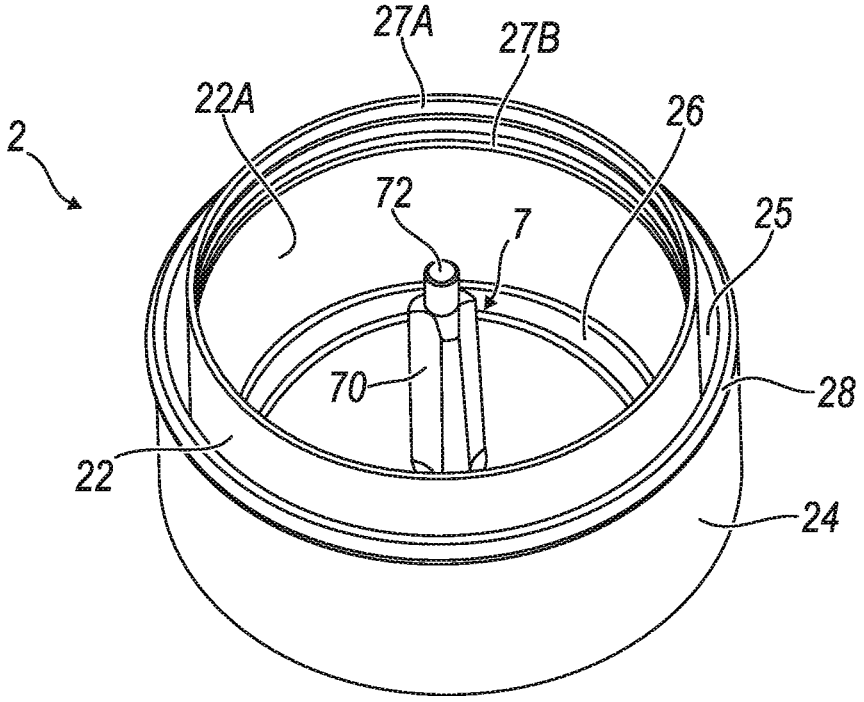
FIGS. 3 and 4 are a perspective view and a plan view respectively of the container illustrated in FIG. 2.
Figure 4:
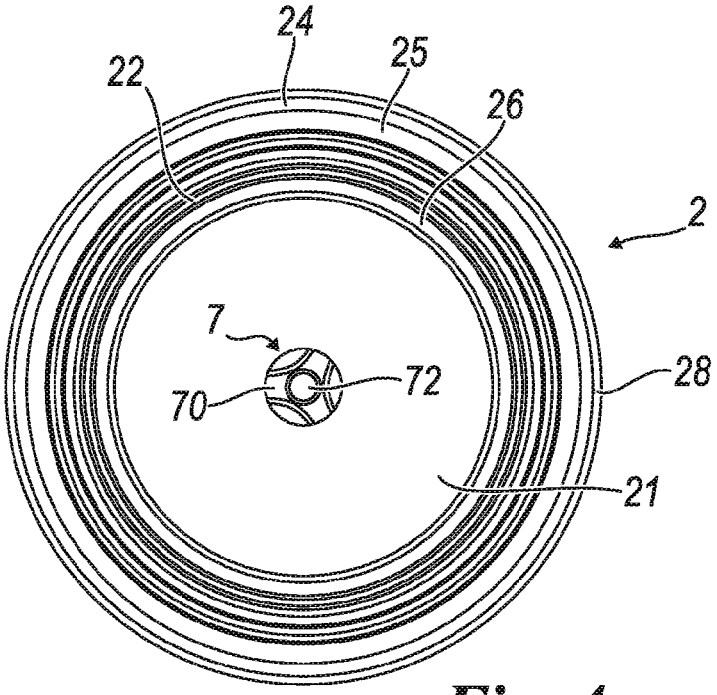

In this event, the at least one duct 71 for making the substance S flow through is obtained by cutting at least one longitudinal recess in the rod 70. In the example here illustrated, the rod 70 has three longitudinal recesses having an arc-of-circle cross-section and reciprocally spaced away from each other (FIGS. 3 and 4). In this way the rod 70 features a substantially hexagonally profiled cross-section, including three concave faces alternating to three convex faces (FIG. 4), and such that it can be inserted into the channel 50 having an hexagonally profiled transversal cross-section (FIG. 7).

Advantageously are the transversal cross-section of the rod 70 and the shape of the channel 50 such as to prevent the feed element 3 from rotating with respect to the container 2 whenever the dispenser cap 6 is rotated. In this way, it is easy to operate a rotation of the dispenser cap 6 about the feed element 3, which does not rotate with respect to the container 2, to bring the device 1 from the opening configuration of the end mouth 52 to the closing configuration of the end mouth 52, and vice versa.

Another advantage of this configuration is in that whenever the rod 70 is inserted into the channel 50, each one of the ducts 71 for the passage of the substance S has a reduced cross-section, which fosters the outflow of the creamy substance S under the pressure caused by the thrust exerted by the piston portion against the substance S.

It is worth noting that the rod 70 advantageously includes an end portion 72 whose lateral dimension is lower than the rest of the rod 70, and such that it can be inserted into the connection element 65 of the dispenser cap 6. The presence of this end portion 72 of the rod 70 is not essential for a good operation of the device 1 according to the invention indeed. It is possible to arrange for the end portion 72 to have a cylindrical or conical shape.

In the device 1 to contain and deliver fluid substances according to the invention, the piston portion 4 of the feed element 3 is operated manually only, by acting onto the dispenser cap 6. In other words, the only way to cause a delivery of the fluid substance S is to manually operate the actuation portion 62 of the dispenser cap 6, in order for the piston portion to push the fluid substance S.

According to a preferred embodiment of the device 1, the feed element 3 is suitable for feeding the substance S outside the container 2 by moving the piston portion 4 from a first initial raised position (visible in FIG. 1), corresponding to when the container 2 is completely filled with the substance S, to a second final lowered position (visible in FIG. 14), corresponding to when the container 2 is substantially empty.

Delivering the dose of the substance S contained in the container 2 is performed by way of one only stroke of the piston portion 4 from said initial raised position to said final lowered position. Such stroke can be performed all at once (which corresponds to a single-dose use) or in several steps. It is worth emphasizing that if the piston portion 4 is moved upwards, i.e. it is moved away from the bottom of the housing 20, this does not allow to deliver a greater quantity of substance S.

Let's point out that the device 1 does not use any types of such return means, for instance springs, as to automatically recall the piston portion towards the initial raised position.

Finally, according to a particularly preferred variant of the invention, the device 1 consists of three components only: the container 2, the feed element 3, and the dispenser cap 6, the guide element 7 being integral with the container 2.

The operation of the invention is the following.

First of all, the housing 20 of the container 2 is filled with the predetermined quantity of the fluid substance S to be delivered.

Then the piston portion 4 of the feed element 3 is inserted into the housing 20, resting against the upper surface of the substance S to be delivered. Advantageously is the feed element 3 already connected to the dispenser cap 6 in this operating step.

When the engagement means 69 provided in the side wall 64 of the dispenser cap 6 are made pass below the engagement counter-means 28 of the outer side wall 24 of the container 2, the piston portion of the feed element 3 is inserted into the housing 20 which contains the substance S in an initial position (FIG. 13). In this position preferably is the dispenser cap 6 associated with the container 2, and a portion of the side wall 64 of the dispenser cap 6 covers a portion of the outer side wall 24 of the container 2.

During the previous assembling step of the device 1, it is preferred that the dispenser cap 6 and the feed element 3 be configured in such a way that the end mouth 52 of the conveyance portion 5 is closed, so as to prevent the substance S to be delivered from being further exposed to air.

At this point, the device 1 to contain and deliver fluid substances is ready for use.

To start delivering the fluid substance S, a user shall rotate the dispenser cap 6 so as to bring it to its opening position.

Then, the user can press on the upper wall 63 of the dispenser cap so as to move the piston portion 4 towards the bottom of the container 2. Such movement causes a thrust onto the fluid substance S which, owing to the piston portion 4 sealingly sliding against the side wall 22 of the housing 20 where the substance S is contained, is forced to pass through the ducts 71 of the rod 70 inserted into the channel 50 of the conveyance portion.

Then the substance S reaches the upper end of the channel 50 and then successively goes to inside the first offshoot 65A, via the first feed mouth 66A, via the end mouth 52 of the conveyance portion 5, via the second feed mouth 66B of the second offshoot 65B, to subsequently run the pipe 60 up to going out through the dispenser mouth 61.

If a user wishes to deliver all the fluid substance S contained in the container 2, he/she shall push the dispenser cap 6 from the initial raised position (FIG. 1) up to the final lowered position (FIG. 15), wherein the lower surface of the plate-shaped body 40 of the piston portion 4 is substantially in contact against the upper surface of the bottom wall 21 of the housing 20.

Conversely, if a user wishes to deliver a part only of the fluid substance S, then he/she shall press on the dispenser cap 6 up to delivering the desired quantity of substance S. The user can bring the device 1 back to the closing position of the end mouth 52 of the conveyance portion 5 (FIGS. 13, 14A and 14B) so as to prevent the substance S from being accidentally and unduly delivered during a possible displacement of the device 1 according to the invention.

FIGS. 15-20B show a second embodiment of the device, which allows to deliver the substance S in at least two predetermined doses. In these figures, the previously described elements common to the first embodiment retain the same reference numbers, which a prime is added thereto.

Figure 15:
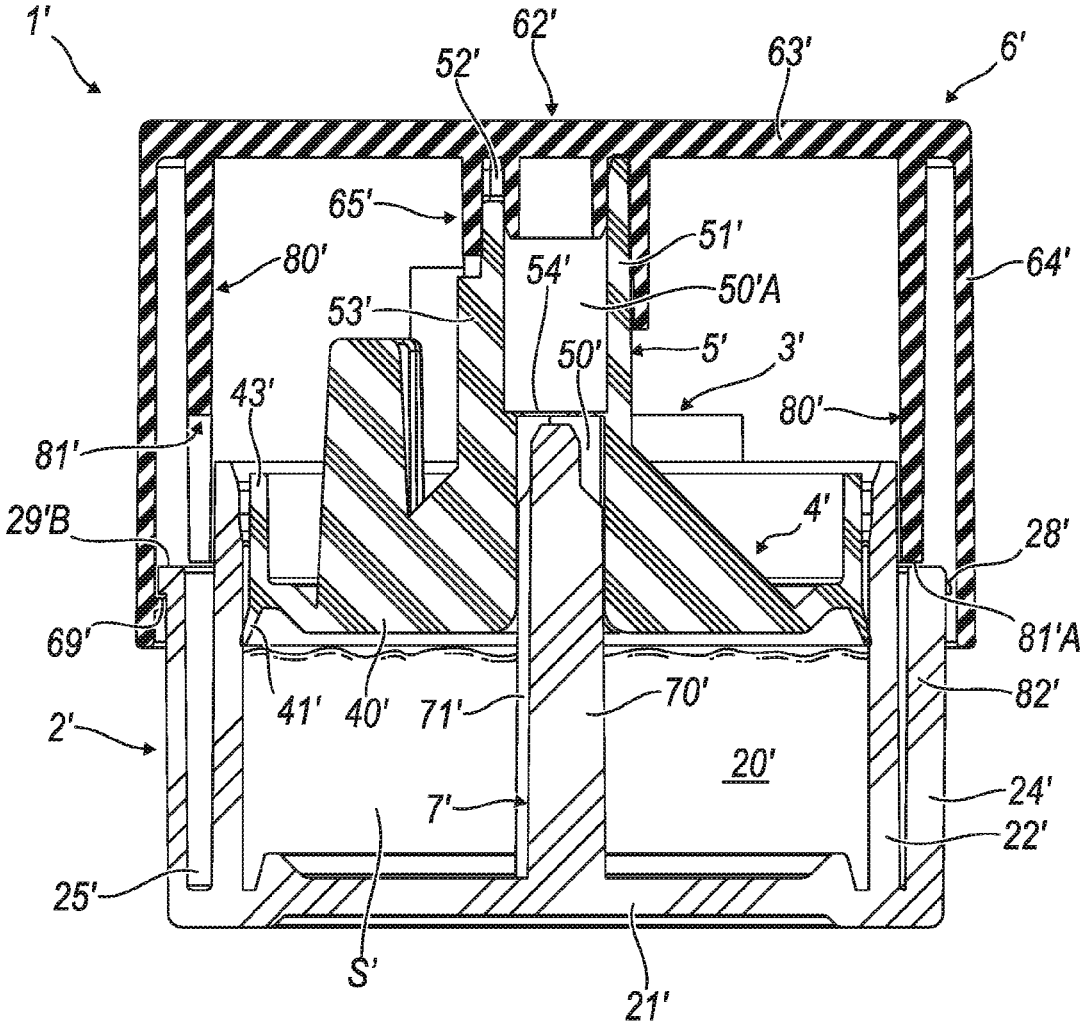
FIG. 15 is an axial sectional view of a second embodiment of the device according to the invention, in a first operating position.
Figure 16:
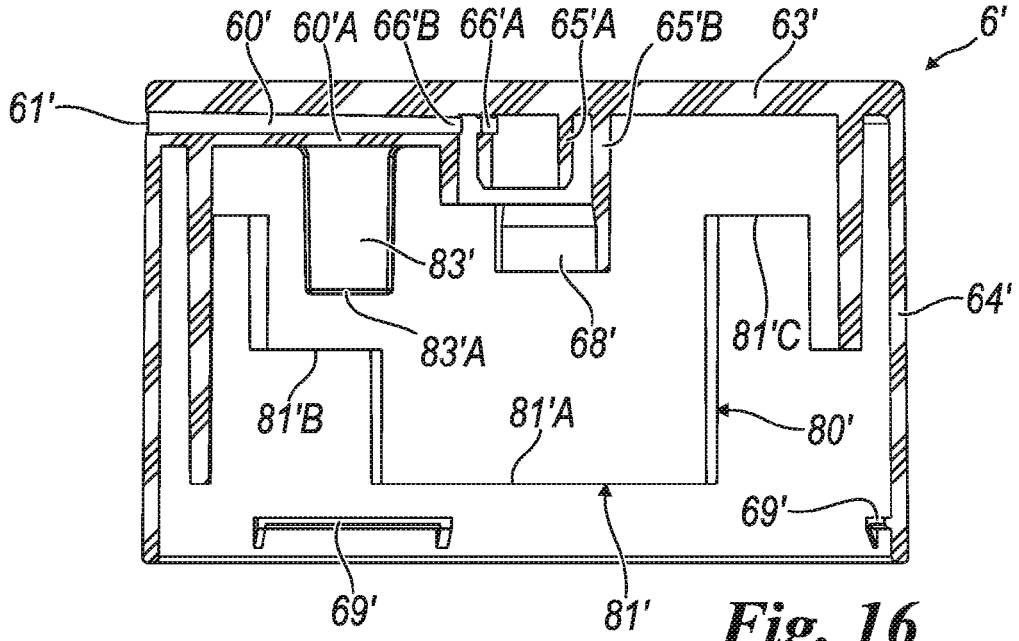
FIGS. 16 and 17 are an axial sectional view and a perspective view respectively of a dispenser cap of the second embodiment of the invention.
Figure 17:
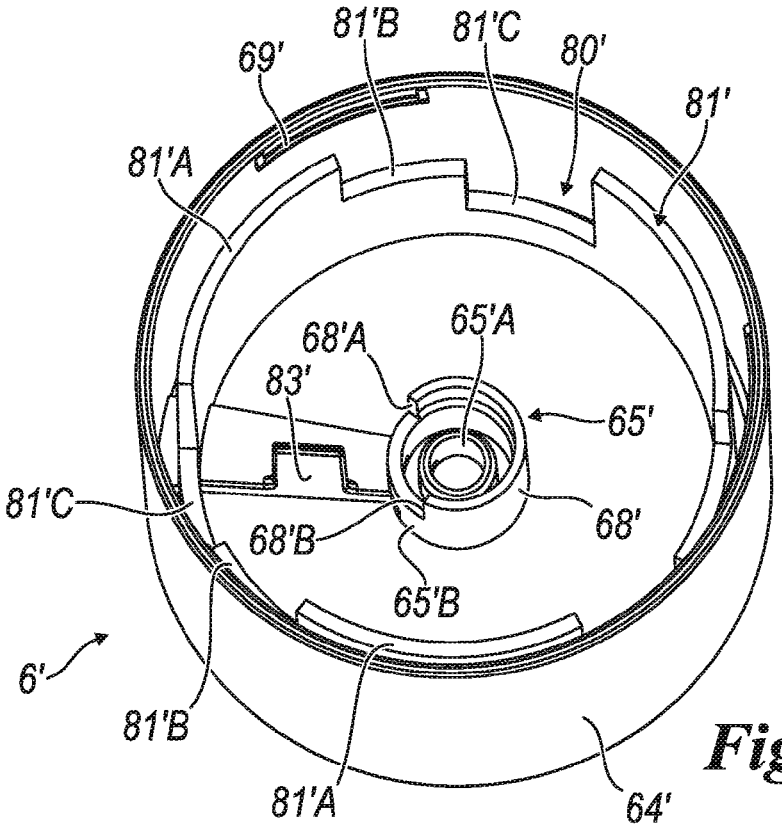
Figure 18:
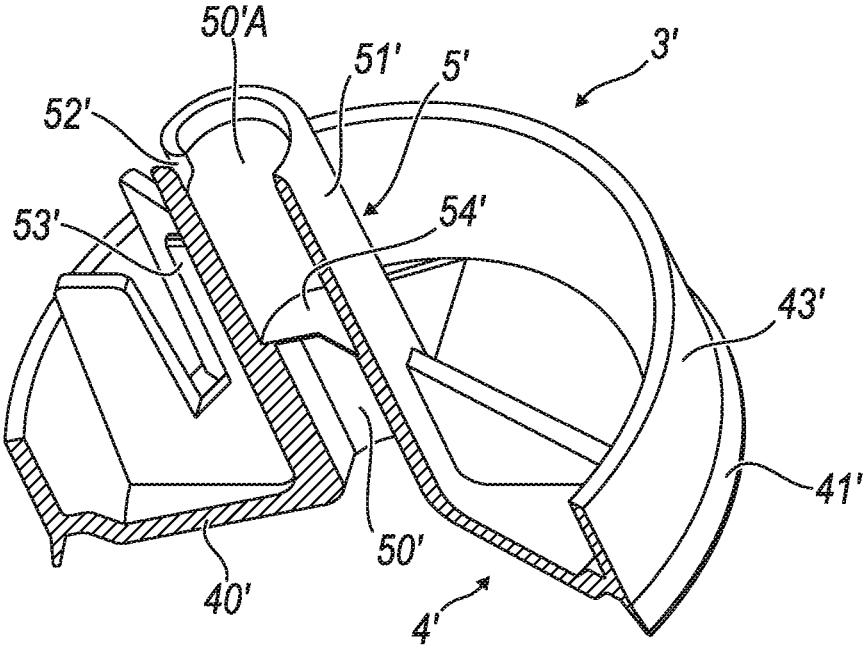
FIG. 18 is a perspective and cross-sectional view of a feed element according to the second embodiment.

In this second embodiment, the dispenser cap 6' comprises at least one partition element 80' which branches-off from the upper wall 63' inside the dispenser cap 6' itself (see FIGS. 15, 16, and 17). The partition element 80' is suitable for being at least partially inserted into the gap 25' between the side wall 22' of the housing 20' and the outer wall 24' of the container 2'. The partition element 80' has a lower edge 81' which forms at least two consecutive steps 81'A, 81'B, 81'C.

Figure 19:
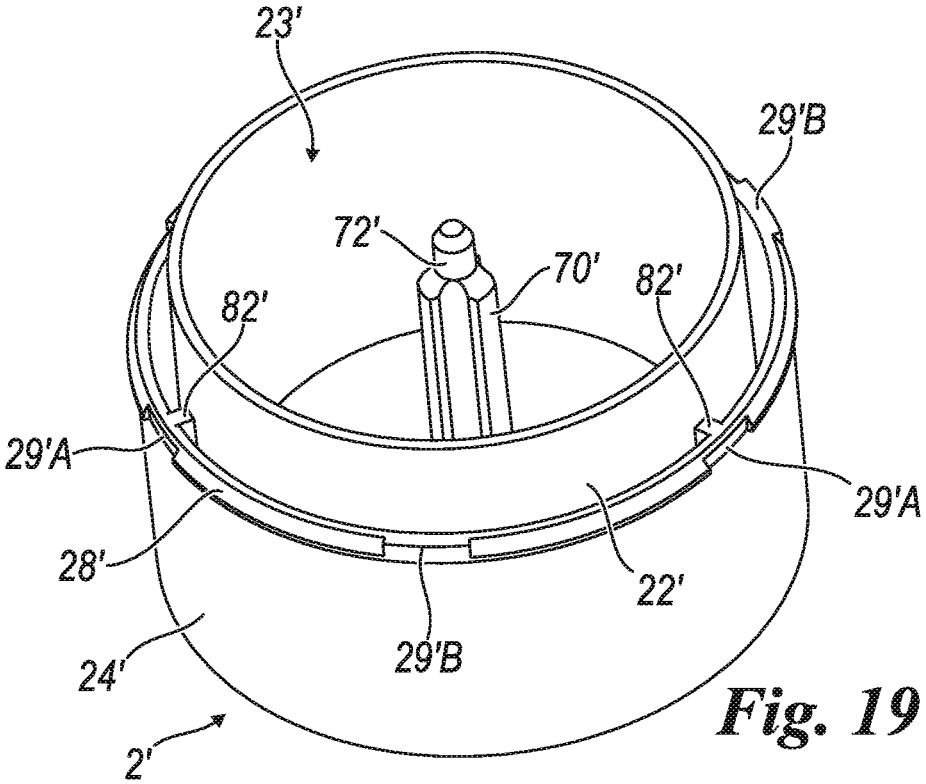
FIG. 19 is a perspective view of a container according to the second embodiment.

Such steps 81'A, 81'B, 81'C of the partition element 80' are suitable for getting in contact with at least one end-of-stroke counter-element 82' provided in the container 2', preferably in said gap 25' (FIGS. 15 and 19).

It is particularly preferred to provide three partition elements 80' and three end-of-stroke counter-elements 82', spaced away by an angle of 120° from each other. The latter are properly positioned with respect to the ducts 71' of the rod 70' of the container 2', so as to allow to make the section of the channel 50' of the conveyance element 5' and the end-of-stroke counter-elements 82' simultaneously coincide with the partition elements 80' during the assembling step.

The cap 6' also comprises a position indicator element 83', preferably comprising a rigid tab extending from the inner surface of the upper wall 63' of the cap 6', for instance from a side edge of the pipe 60' (FIGS. 16 and 17).

The second embodiment also includes a breakable membrane 54' in the channel 50' of the conveyance element 5' (FIGS. 15 and 18) suitable for closing such channel 50' and providing air-tightness to the housing 20' during the assembling step. Such breakable membrane 54' is destined to be opened by the end portion 72' of the rod 70' upon the first delivery of substance S' by the user. In order to make opening easier, the membrane 54' can include weakening lines or other elements suitable for guiding the breakage of the membrane 54'.

Such breakable membrane 54', further to ensure the sealing of the channel 50' of the conveyance portion 5' before the first use of the device 1', also acts as a safety seal. In order to break this membrane 54' it is necessary to exert such a predetermined force that the user certainly notices the presence of the membrane 54' when he uses the device 1' for the first time. This membrane 54' indicates that the device 1' has not been previously used yet.

The feed element 3' comprises at least one position indicator counter-element 84' suitable for interacting with the indicator element 83' of the cap 6'. Such counter-elements 84' preferably comprise one rigid tab each.

The tab 83' and the counter-tabs 84' have such a shape that the lower edge 83'A of the tab 83' abuts on the upper edge 84'A of the counter-tab 84' to enable it to click and overstep it.

Advantageously, the circular tooth that makes-up the engagement counter-means 28' of the container 2' includes three recesses 29'A and three projections 29'B alternating to each other and separated from each other by an angle of 60°. The recesses 29'A are suitable for facilitating the passage of the engagement means 69' of the cap 6' through the engagement counter-means 28', whereas the projections 29'B are suitable for operating as an abut for the same engagement means 69', so as to prevent a first accidental operation of the device 1'. In this way an undesired opening of the membrane 54' of the channel 50' that conveys the substance S' is avoided.

Said otherwise, the projections 29'B act as block elements for blocking the handling of the dispenser cap 6'.

By using this embodiment of the device 1', a user can pick-up the substance S' by way of a number of pressures predetermined by the number of steps 81'A, 81'B, 81'C of the partition element 80'. Initially, the device 1' is set to a closed position, and the first steps 81'A of the partitioning element 80' abut on the end-of-stroke counter-elements (82'), as illustrated in FIG. 15.

In this situation, also the end-of-stroke counter-elements 82' act as block elements for blocking the handling of the dispenser cap 6', while for instance the engagement means 69' are already positioned under the circular tooth 28', and so under the corresponding projections 29'B (FIG. 15).

The user first opens the device 1' by rotating the dispenser cap 6' with respect to the feed element 3'. During this rotation, the position indicator element 83' gets in contact with a first indicator counter-element 84', and oversteps it by a first click. Such first click informs the user that the device 1' is set to the open position.

Figure 20A:
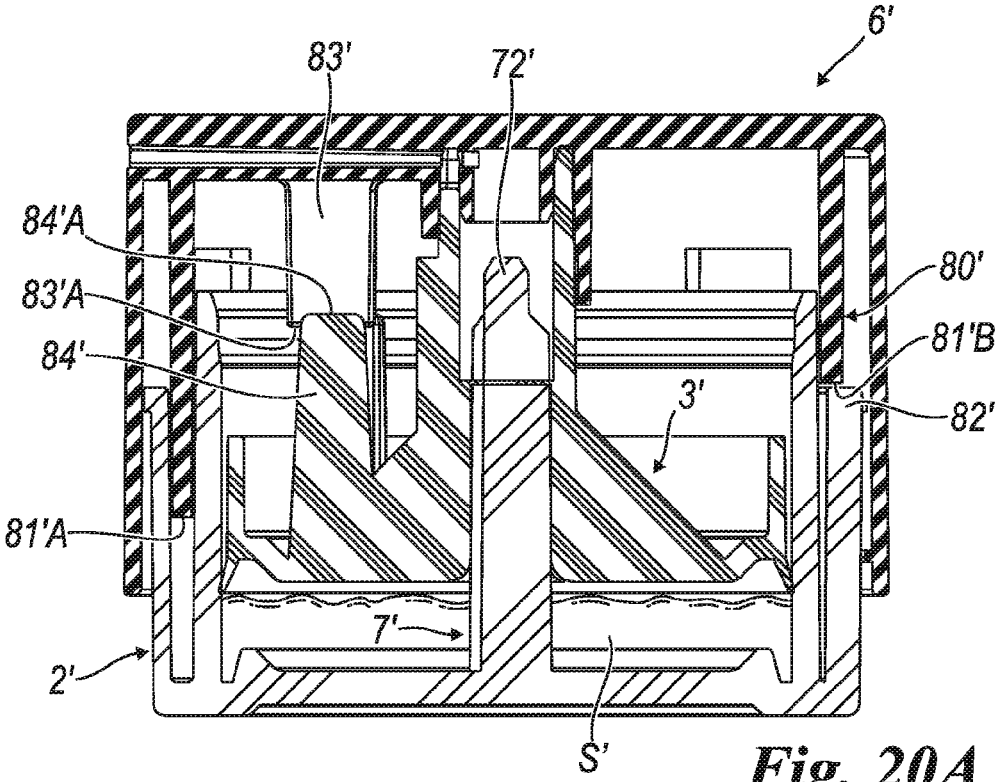
FIGS. 20A and 20B are axial sectional views of the second embodiment of the device according to the invention, in two further operating positions.

Then, the user can deliver a first dose of the substance S', by pressing on the dispenser cap 6' until the second steps 81'B of the partition element 80' get in contact with the end-of-stroke counter-elements 82' (FIG. 20A).

Figure 20B:
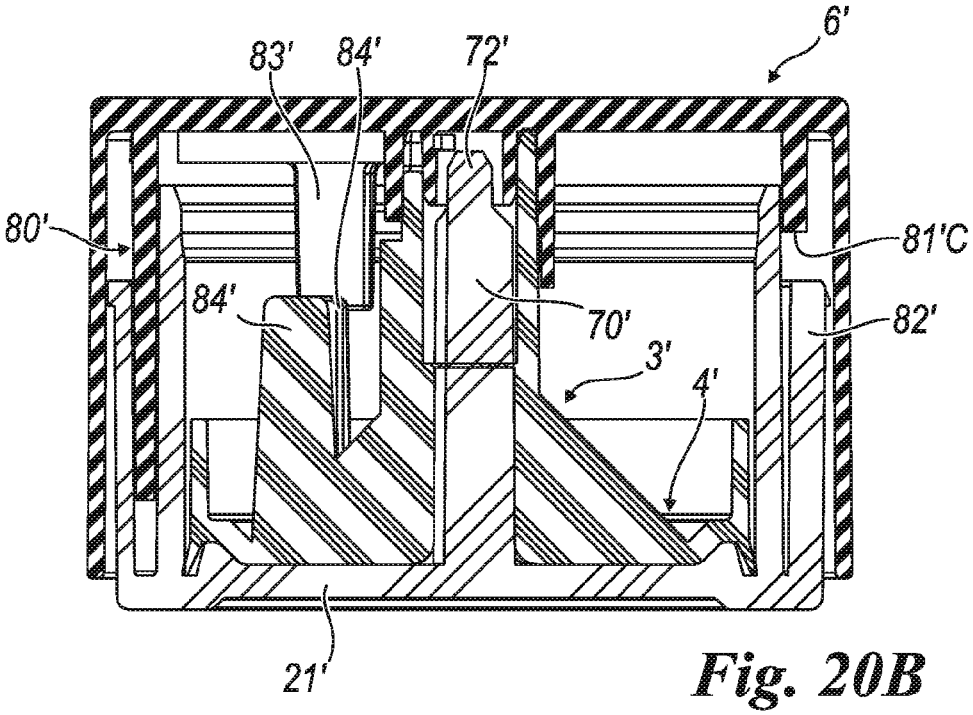
Figure 21:
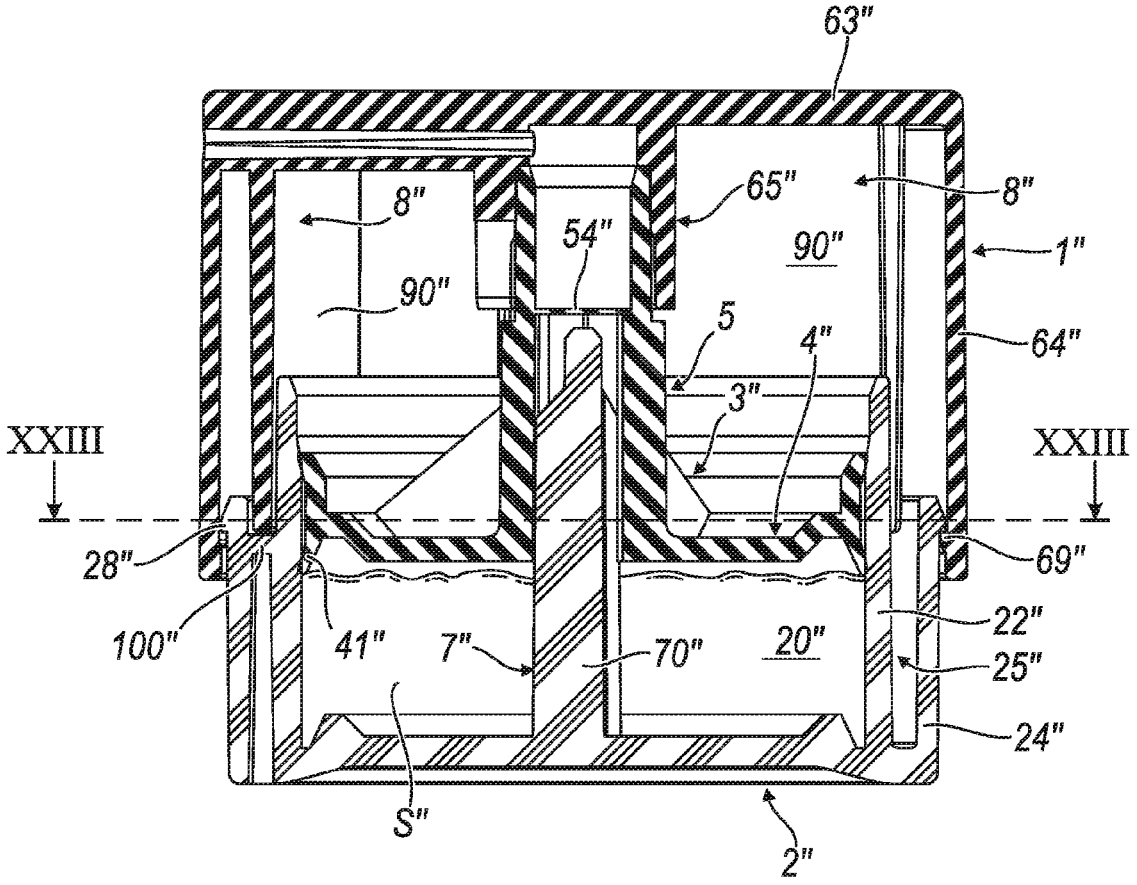
FIGS. 21 and 22 are axial sectional views of a third embodiment of the device according to the invention, in a first operating position.
Figure 22:
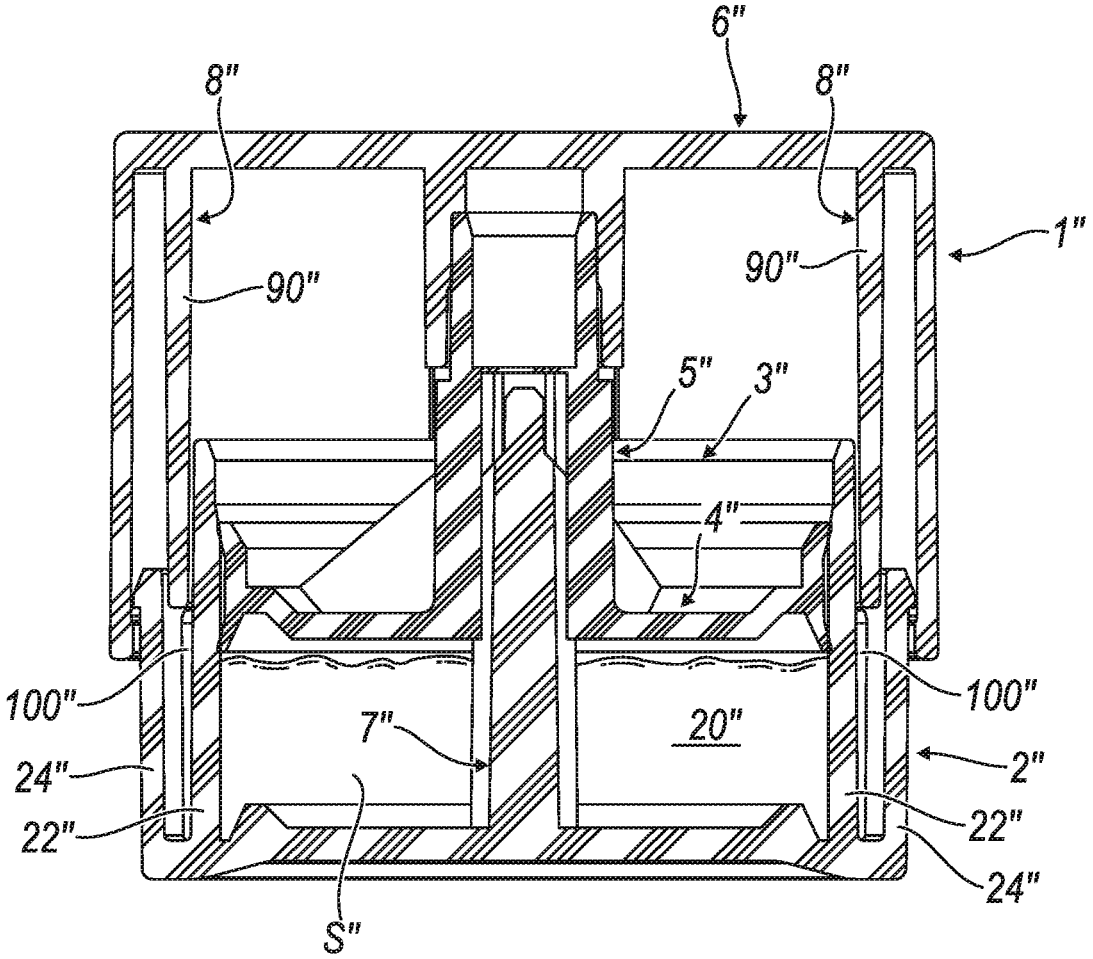

In order to deliver a second dose of the substance S', the user shall rotate the dispenser cap 6' again with respect to the feed element 3' to line-up the third steps 81'C with the end-of-stroke counter-elements 82' and this way to continue the movement of the piston element 4' towards the bottom of the housing 20' until the third steps 81'C get in contact with the end-of-stroke counter-elements 82', or until the piston element 4' get in contact with the bottom wall 21' of the housing 20', the container 2' being empty (FIG. 20B).

Note that when said second rotation of the cap 6' is made, the position indicator element 83' will have caused a click with a second position indicator counter-element 84', thus informing the user about the possibility of delivering a second dose of substance S'.

FIGS. 21-24 show a third embodiment of the device. In these figures, the previously described elements common to the first embodiment retain the same reference numbers, which a double quote is added thereto.

In this third embodiment, device 1" also comprises a further guide element 8" (in addition to the guide element 7" arranged in the container 2", previously described) suitable for interacting with the inner surface or the outer surface of the side wall 22" of the container 2".

In the example of FIGS. 21-24, this further guide element 8" comprises at least one lip 90" which extends perpendicularly from the upper wall 63" of the dispenser cap 6" (FIGS. 21 and 22) along a circular trajectory, and at such a distance as to be placed at the gap 25" between the side wall 22" and the outer wall 24" of the container 2". in particular in the illustrated example the further guide element 8" comprises three lips 90" angularly distributed.

It can therefore be deduced that in this configuration the lip 90" slide along the outer surface of the side wall 22" of the container 2".

Alternatively it is also possible to provide that the further guide element 8" to be arranged on the conveyance portion 5" of the feed element 3", as a disc-shaped element, or as a plurality of disk partitions (for instance three disk partitions), which extends perpendicularly from the tubular body 51", above the piston portion 4". In this case, instead, the further guide element 8" slides along the inner surface of the side wall 22" of the container 2".

It is also worth underlying that the device 1" is provided with at least one block element 100" for blocking the handling of the dispenser cap 6". Such block element 100" prevents the dispenser cap 6" from being accidentally pressed and provoking the undesired delivery of the fluid substance S".

Figure 23:
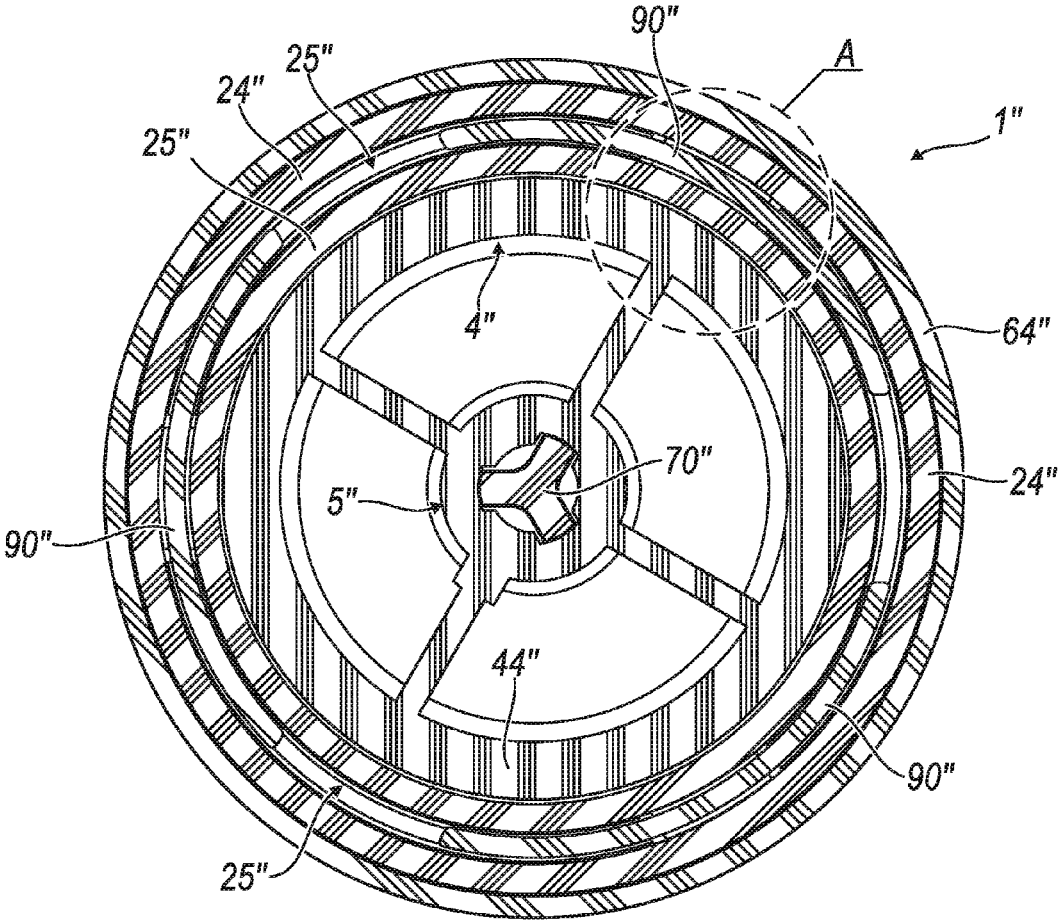
FIG. 23 is a plant and sectional view of the device of FIGS. 21 and 22 according to the line XXIII-XXIII in FIG. 21.
Figure 24:
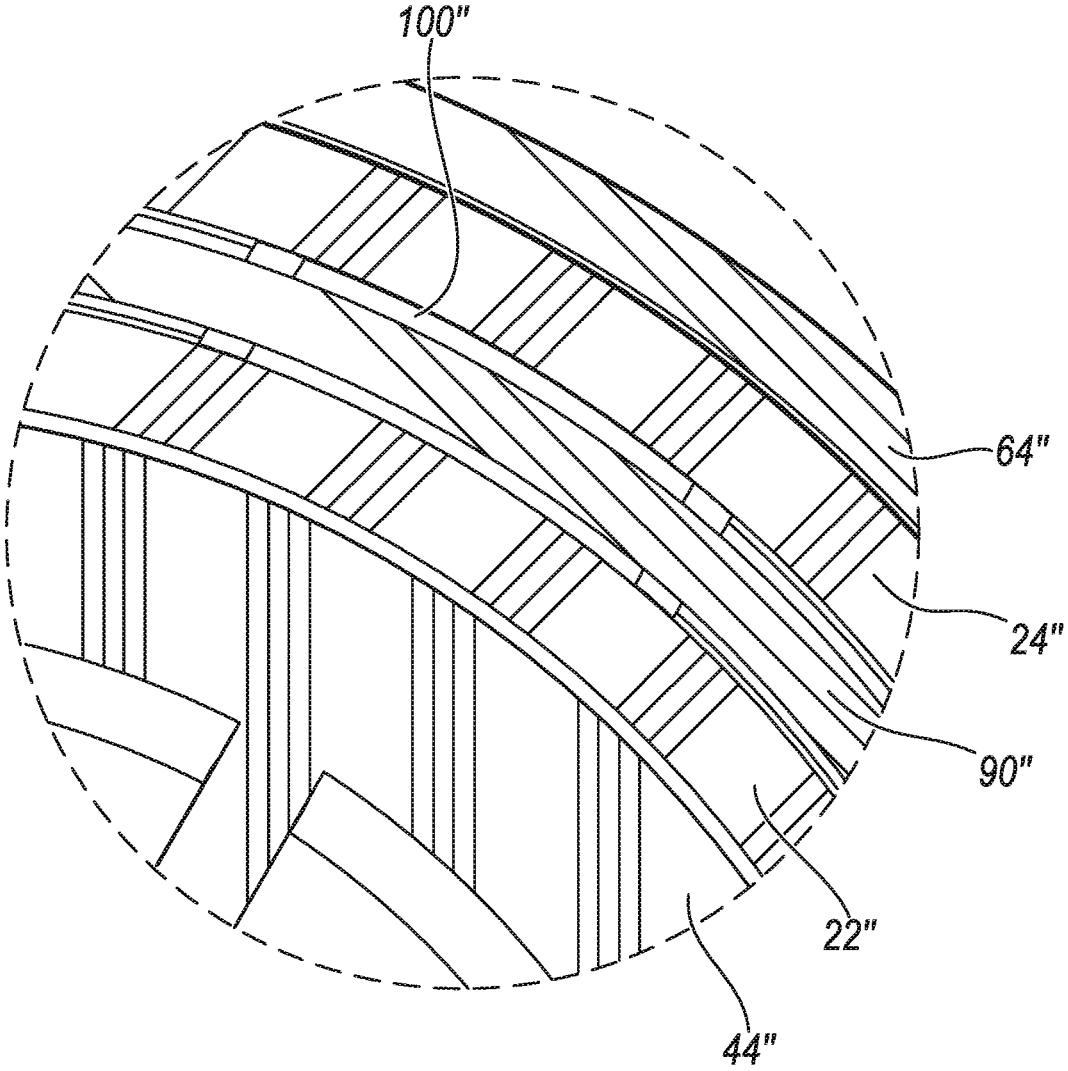
FIG. 24 is an increased detail of the area indicated with letter A in FIG. 23.

In the example of FIGS. 21-24 the device 1" comprises three block elements 100" angularly distributed, and arranged in the gap 25" between the side wall 22" and the outer wall 24" of the container 2" (see in particular FIGS. 23 and 24). Such block elements 100" act as abutments for the lower edge of the lips 90".

The further guide element 8" allows to enhance the guidance of the feed element 3", in particular during the first handling of the dispenser cap 6" which determines the breaking of the membrane 54". The presence of the further guide element 8" enables to avoid, or at least to limit, the misalignment of the dispenser cap 6" at the moment of the breaking of the membrane 54".

The invention claimed is:

1. A device to contain and deliver fluid substances, comprising:

a container comprising a housing suitable to contain a substance to be delivered, said housing having a bottom wall and at least one side wall delimiting an opening;

a feed element to feed said substance outside the container, having a piston portion suitable to be inserted inside said housing of the container and to sealingly slide against said at least one side wall so as to exert pressure on said substance contained in said housing of the container, and a conveyance portion connected to said piston portion having at least one channel to convey said substance outside said housing;

a dispenser cap comprising a connection element for said channel of the feed element, with at least one pipe for said dispenser cap, one dispenser mouth for said substance connected to said pipe, and one actuation portion suitable to be hand-operated to manually handle said feed element so as to push said piston portion into said housing of the container and deliver the substance;

at least one guide element to guide the handling of said piston portion into said housing of the container, said guide element comprising a rod extending from said bottom wall of the housing of the container and suitable to be inserted in said channel of the conveyance portion of the feed element;

wherein said rod comprises at least one duct for flowing there through the substance to be delivered;

wherein said piston portion of said feed element is handled only manually by acting on said dispenser cap.

2. The device according to claim 1, consisting of only three components: the container, the feed element and the dispenser cap, said at least one guide element being integral with said container.

3. The device according to claim 1, wherein the rod is arranged coaxially with respect to the housing of the container.

4. The device according to claim 1, wherein the container comprises an outer side wall, separate and distinct from a side wall of the housing containing the substance to be delivered.

5. The device according to claim 1, characterised in that wherein the housing containing the substance and the piston portion of the feed element are shaped to allow all said substance to be delivered by manually actuating said piston portion a single time.

6. The device according to claim 1, wherein the housing containing the substance to be delivered has a volume of less than 15 ml.

7. The device according to claim 1, wherein the housing of the container has a cylindrical shape and the piston portion of the feed element is disc-shaped to be sealingly introduced against the side wall of said housing of the container and to move coaxially relative to said housing, and in that the conveyance portion centrally branches off from said piston portion and has at least the channel for delivering the substance.

8. The device according to claim 1, wherein the dispenser cap comprises closure means for an end mouth of said conveyance portion of the feed element, suitable to let said end mouth open/closed, and said dispenser cap is rotatingly connected to the feed element between an opening position, wherein a pipe of the dispenser cap is in communication with said conveyance portion of the feed element, and a closing position, wherein said end mouth of the conveyance portion is closed by said closure means of the dispenser cap.

9. The device according to claim 1, wherein the dispenser cap comprises an upper wall and at least one side wall, the container comprising an outer side wall, and said side wall of the dispenser cap and said outer wall of the container are shaped in such a way that a portion of said side wall of the dispenser cap covers and slides along at least one portion of the outer wall of the container.

10. The device according to claim 9, wherein the dispenser cap is provided with engagement means in the side wall of the dispensing cap, the container being provided with engagement counter-means suitable to cooperate with said engagement means of the dispenser cap, so as to prevent said dispenser cap from being accidentally removed after said dispenser cap has been associated to the container.

11. The device according to claim 1, wherein the feed element is suitable to feed the substance outside the container by a single handling of the piston portion from a first, raised starting position, when the container is completely filled with the substance, to a second, lowered ending position, when the container is substantially empty.

12. The device according to claim 1, wherein the guide element is suitable to allow said piston portion only to translate axially relative to said housing of said container, and said connection element connecting said dispenser cap to said feed element is suitable to allow said dispenser cap to translate axially relative to said housing of the container along with said piston portion and also to rotate around a central axis of said piston portion.

13. The device according to claim 1, wherein the dispenser cap comprises at least one partitioning element splitting up the delivery of the substance, comprising a lower edge forming at least two consecutive steps suitable to come in contact with at least one end-of-stroke counter element provided in the container.

14. The device according to claim 1, comprising at least a further guide element to guide the handling of the piston portion in the housing of the container, suitable for interacting with the inner surface or the outer surface of the side wall of the container.

15. The device according to claim 1, comprising at least a block element for blocking the handling of the dispenser cap and an undesired delivery of the fluid substance.

* * * * *